United States Patent [19]

O'Grady et al.

[11] Patent Number: 4,536,277

[45] Date of Patent: Aug. 20, 1985

[54] SHALE OIL STABILIZATION WITH A HYDROGEN DONOR QUENCH AND A HYDROGEN TRANSFER CATALYST

[75] Inventors: Thomas M. O'Grady, Naperville; David F. Tatterson, Downers Grove; Ronald Coates, Naperville, all of Ill.

[73] Assignee: Standard Oil Company (Indiana), Chicago, Ill.

[21] Appl. No.: 583,150

[22] Filed: Feb. 24, 1984

[51] Int. Cl.[3] ..... C10G 1/00

[52] U.S. Cl. ..... 208/11 R; 208/177; 208/89

[58] Field of Search ..... 208/11 R, 56, 89, 107, 208/177

[56] References Cited

U.S. PATENT DOCUMENTS

| | | | |
|---|---|---|---|
| 2,692,226 | 10/1954 | Smith | 208/11 R |
| 3,297,563 | 1/1967 | Doumani | 208/89 X |
| 3,558,475 | 1/1971 | Jaffe | 208/89 X |
| 3,565,751 | 2/1971 | Hoekstra | 208/11 R X |
| 3,655,518 | 4/1972 | Schmalfeld et al. | 208/11 R X |
| 4,022,683 | 6/1977 | Bludis et al. | 208/89 X |
| 4,029,571 | 6/1977 | Curtin | 208/107 X |
| 4,101,416 | 7/1978 | Dolbear | 208/108 |
| 4,115,246 | 9/1978 | Sweany | 208/56 |
| 4,155,832 | 5/1979 | Cox et al. | 208/11 R X |
| 4,324,643 | 4/1982 | Durai-Swamy | 208/11 R X |
| 4,344,840 | 8/1982 | Kunesh | 208/11 R X |
| 4,366,047 | 12/1982 | Winter et al. | 208/107 X |
| 4,415,430 | 11/1983 | York | 208/11 R X |
| 4,415,434 | 11/1983 | Hargreaves et al. | 208/11 R |

*Primary Examiner*—D. E. Gantz
*Assistant Examiner*—Glenn A. Caldarola
*Attorney, Agent, or Firm*—Thomas W. Tolpin; William T. McClain; William H. Magidson

[57] ABSTRACT

A process is provided to produce and stabilize shale oil. In the process, raw oil shale is retorted with heat carrier material to liberate an effluent product stream comprising hydrocarbons and entrained particulates of oil shale dust. In order to minimize polymerization of the product stream and agglomerate the shale dust, the product stream is stabilized with a hydrogen donor quench in the presence of a hydrogen transfer catalyst upon exiting the retort. The quenched stream is subsequently purged of catalyst, dedusted, and upgraded.

19 Claims, 2 Drawing Figures

SHALE OIL STABILIZATION WITH A HYDROGEN DONOR QUENCH AND A HYDROGEN TRANSFER CATALYST

BACKGROUND OF THE INVENTION

This invention relates to oil shale, and more particularly, to a surface retorting process for producing and stabilizing shale oil.

Researchers recently renewed their efforts to find alternate sources of energy and hydrocarbons in view of rapid increases in the price of crude oil and natural gas. Much research has been focused on recovering hydrocarbons from solid hydrocarbon-containing material such as oil shale, coal and tar sands by retorting or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be efficiently converted to oil by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis or retorting of kerogen in the oil shale. Crude shale oil, sometimes referred to as "retort oil," is the liquid oil product recovered from the liberated effluent of an oil shale retort. Syncrude is the upgraded product of shale oil.

The process of pyrolyzing the kerogen in oil shale, known as retorting, to form liberated hydrocarbons can be done in surface retorts in aboveground vessels or in in situ retorts underground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In surface retorting, oil shale is mined from the ground, brought to the surface, crushed and placed in vessels where it can be contacted with a hot solid heat carrier material, such as hot spent shale, ceramic balls, metal balls, or sand or a gaseous heat carrier material, such as light hydrocarbon gases, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material can be removed from the retort and recycled as heat carrier material or discarded. The combustion gases are dedusted in cyclones, electrostatic precipitators, or other gas-solid separation systems.

During fluid bed, moving bed and other types of surface retorting, decrepitation of oil shale occurs when particles of oil shale collide with each other or impinge against the walls of the retort forming substantial quantities of minute entrained particulates of shale dust. The use of hot spent shale as heat carrier material can aggravate the dust problem. Rapid retorting is desirable to minimize thermal cracking of valuable condensable hydrocarbons. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sands, gilsonite, and oil-containing diatomaceous earth create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it can be separated into fractions of light gases, light oils, middle oils and heavy oils with the bottom heavy oil fraction containing essentially all of the dust. As much as 65% by weight of the bottom heavy oil fraction may consist of dust.

It is very desirable to upgrade the bottom heavy oil into more marketable products, such as light oils and middle oils, but because the heavy oil fraction is laden with dust, it is very viscous and cannot be pipelined. Newly produced fresh shale oil has many free radicals and a transient chemical composition that rapidly polymerizes, ages, and decrepitates which greatly increases the viscosity of the oil and aggravates dust problems. Dust laden heavy oil plugs up hydrotreaters and catalytic crackers, abrades valves, heat exchangers, outlet orifices, pumps and distillation towers, builds up insulative layers on heat exchange surfaces reducing their efficiency and fouls up other equipment. Furthermore, the dusty heavy oil erodes turbine blades and creates emission problems. Moreover, the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at high temperatures and the product stream must be maintained at approximately the temperature attained during the retorting process to prevent any condensation and accumulation of dust on processing equipment. Maintaining the effluent stream at high temperatures allows detrimental side reactions, such as cracking, coking and polymerization of the effluent product stream, which tends to decrease the yield and quality of condensable hydrocarbons.

Over the years, various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocycloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 1,668,898; 1,687,763; 1,703,192; 1,707,759; 1,788,515; 2,235,639; 2,524,859; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,910,834; 3,929,625; 3,951,771; 3,974,073; 3,990,885; 4,028,222; 4,040,958; 4,049,540; 4,057,490; 4,069,133; 4,080,285; 4,088,567; 4,105,536; 4,151,067; 4,151,073; 4,158,622; 4,159,949; 4,162,965; 4,166,441; 4,182,672; 4,199,432; 4,220,522; 4,226,699; 4,246,093; 4,293,401; 4,324,651; 4,354,856; and 4,388,179 as well as in the articles by Rammler, R. W., *The Retorting of Coal, Oil Shale and Tar Sand By Means of Circulated Fine-Grained Heat Carriers as a Preliminary Stage in the Production of Synthetic Crude Oil,* Volume 65, Number 4, Quarterly of the Colorado School of Mines, pages 141–167 (October 1970) and Schmalfeld, I. P., *The Use of The Lurgi/Ruhrgas Process For The Distillation of Oil Shale,* Volume 70, Number 3, Quarterly of the Colorado School of Mines, pages 129–145 (July 1975).

The use of hydrogen donors, hydrogen, capping agents, and a variety of solvents have been suggested over the years for enhancing different aspects of oil shale retorting, coal liquefaction, catalytic cracking, and oil upgrading. Typifying these prior art processes are those shown in U.S. Pat. Nos. 2,847,306; 3,617,513; 3,799,722; 4,089,772; 4,094,766; 4,115,246; 4,133,646; 4,134,821; 4,178,229; 4,189,372; 4,293,404; 4,294,686; 4,298,451; 4,326,944; 4,330,394; 4,363,637; 4,375,402; and 4,324,637–644.

The above prior art processes have met with varying degrees of success.

It is therefore desirable to provide an improved process for producing and stabilizing shale oil.

SUMMARY OF THE INVENTION

An improved process is provided to produce and stabilize shale oil in a manner which effectively and efficiently retards shale oil polymerization, aging and decrepitation. The novel process allows increased agglomeration of oil shale dust and assures a higher quality product at desirable viscosities. Advantageously, the stabilized oil can be more readily dedusted, pipelined and upgraded in hydrotreaters and catalytic crackers.

Shale oil can be produced in this process aboveground in surface retorts, or in solvent extraction vessels, or can be produced underground in modified or true in situ retorts. In the preferred form, the oil is produced in a surface retort, by mixing raw oil shale in the retort with solid heat carrier material, such as spent oil shale, at a sufficient retorting temperature to liberate an effluent product stream of hydrocarbons containing entrained particulates of oil shale dust. The surface retort can be a static mixer retort, gravity flow retort, fluid bed retort, screw conveyor retort, or rotating pyrolysis drum retort. Such retorts typically include a surge bin, collection vessel, or accumulator. Other types of retorts such as rock pump retorts and rotating grate retorts can be used.

In the preferred form, the effluent product stream of hydrocarbons is partially dedusted in a cyclone, ceramic filter, or some other gas-solids separation device before being fed to at least one fractionator, quench tower, scrubber, or condenser where it is separated into one or more fractions of normally liquid shale oil. The dust laden fraction of whole shale oil or heavy shale oil is then dedusted in one or more dedusters (solids-liquids separation devices), such as hot centrifuges, dryers, and/or desalters.

In order to stabilize the shale oil, a hydrogen donor quench is injected into the product stream along with a hydrogen transfer catalyst immediately upon exiting the retort. In the preferred process, the hydrogen donor quench and the hydrogen transfer catalyst are injected upstream of the gas-solids separation device, fractionator, and deduster for enhanced efficiency and effectiveness at a temperature and pressure substantially similar to the temperature and pressure of the retort, most preferably from about atmospheric pressure to about 50 psig.

In the preferred embodiment, the hydrogen donor is process derived from a cut (fraction) of shale oil. Preferably, the cut of shale oil is obtained from a distillation column or extraction vessel located between a first stage, mild severity upgrading reactor and a second stage, high severity upgrading reactor. The reactors can be hydrocrackers, catalytic crackers, or hydrotreaters, such as an ebullated bed reactor, fluid bed reactor, and most preferably, a fixed bed reactor. Mild severity hydrotreating saturates and hydrogenates the aromatic rings of the shale oil hydrogen honor without removing the nitrogen and heteroatoms, as occurs in high severity hydrotreating.

The process derived hydrogen donor has mono or polycyclic aromatic rings containing electro-negative heteroatoms such as oxygen, sulfur and nitrogen. The heteroatoms enhance the hydrogen donating capability of the hydrogen donor molecules. When these hydrogen donor molecules are injected into the product stream they limit polymerization of the shale oil by stabilizing free radicals in the oil generated by the retorting process. The stabilization is affected by the hydrogen donor molecules donating hydrogen atoms to be free radicals. The hydrogen donor also agglomerates a substantial amount of the dust in the shale oil by preventing and reducing the extent to which the dust surface is covered with polymerized shale oil. This action enhances the hydrophilic nature of the dust surface which in turn enhances agglomeration of the dust thereby reducing dedusting costs.

While the above hydrogen donor is preferred for reasons of process efficiency and economy, other hydrogen donors can also be used, if desired.

In the process, the hydrogen transfer catalyst and the particulates of oil shale dust are separated and removed from the product stream in one or more gas-solids separation devices, such as a cyclone or filter. The hydrogen transfer catalyst can be separated from the shale dust in a dust/catalyst separation device by gravity separation, screening, or filtering because the hydrogen transfer catalysts are bigger than the particulates of shale dust. The removed, spent hydrogen transfer catalyst can be regenerated or otherwise treated to remove shale dust and trace metals from the catalyst.

The hydrogen transfer catalyst increases the reaction rate of the hydrogen donor quench in stabilizing and retarding aging of the product stream of shale oil as well as in limiting polymerization and enhancing shale dust agglomeration of the product stream. The hydrogen transfer catalysts can be platinum, irridium, cobalt molybdenum, nickel, chromium, or combinations thereof, on a suitable support such as alumina, carbon, silica or combinations thereof. Other hydrogen transfer catalysts can also be used.

As used in this application, the term "dust" means particulates derived from oil shale. The particulates range in size from less than 1 micron to 1000 microns and include retorted and raw unretorted particles of oil shale, as well as spent oil shale, if the latter is used as solid heat carrier material during retorting. Dust derived from retorting of oil shale consists primarily of clays, calcium, magnesium oxides, carbonates, silicates, and silicas.

The term "retorted" oil shale as used in this application refers to oil shale which has been retorted to liberate hydrocarbons leaving an inorganic material containing carbon residue.

The term "spent" oil shale as used herein means oil shale from which most of the carbon residue has been removed by combustion.

The term "synthetic oil" as used herein means oil which has been produced from oil shale. The synthetic oil in the present process is dedusted according to the principles of the present invention before being fully upgraded.

The terms "dust-laden" or "dusty" synthetic oil as used herein mean synthetic oil which contains a substantial amount of entrained particulates of oil shale dust.

The terms "hydrogen donor" and "hydrogen donor quench" as used herein mean a hydrogen donor type compound, precursor, and/or radical which tends to stabilize shale oil.

The term "process derived" hydrogen donor as used herein means a hydrogen donor which is obtained and produced from the oil shale retorting and/or shale oil upgrading process.

The term "hydrogen transfer catalyst" as used herein means a catalyst which increases the reaction rate of the hydrogen donor quench in stabilizing shale oil.

The terms "normally liquid," "normally gaseous," "condensable," "condensed," or "noncondensable" are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENTS

Figure 1:
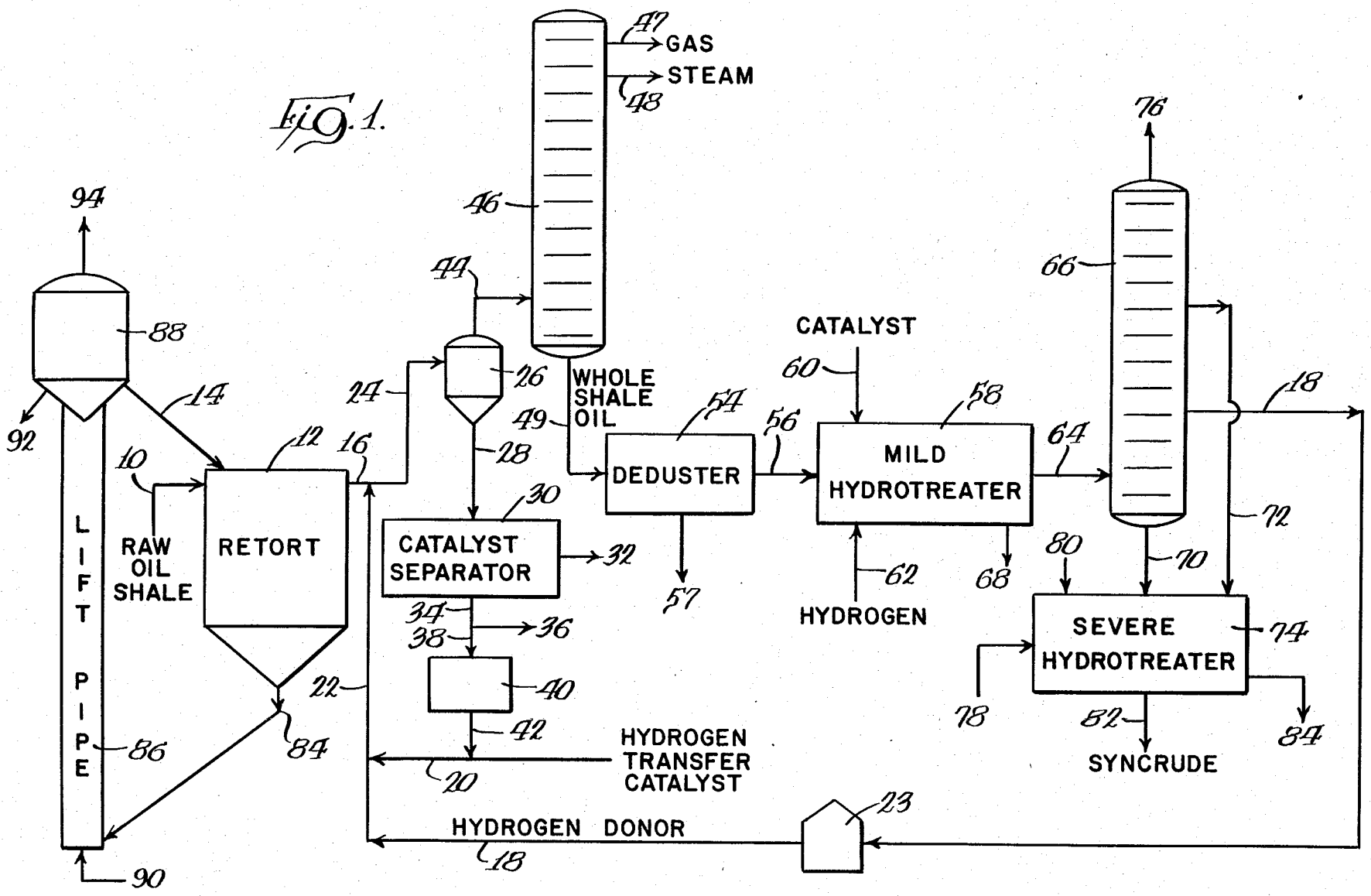
FIG. 1 is a schematic flow diagram of a process for producing and stabilizing shale oil in accordance with principles of the present invention.

Referring now to FIG. 1, an oil shale retorting and shale oil stabilizing and upgrading process is provided to produce, stabilize and upgrade shale oil.

In the process and system, raw, fresh oil shale, which preferably contains an oil yield of at least 15 gallons per ton of shale particles, is crushed and sized to a maximum fluidizable size of 10 mm and fed through raw shale inlet line 10 at a temperature from ambient temperature to 600° F. into an aboveground surface retort 12. The retort can be a gravity flow retort, a static mixer retort with a surge bin, a fluid bed retort, a rotating pyrolysis drum retort with an accumulator having a rotating trommel screen, or a screw conveyor retort with a surge bin. The fresh oil shale can be crushed by conventional crushing equipment, such as an impact crusher, jaw crusher, gyratory crusher, roll crusher, and screened with conventional screening equipment, such as a shaker screen or a vibrating screen.

Spent (combusted) oil shale and spent (combusted) dried sludge, which together provide solid heat carrier material, are fed through heat carrier line 14 at a temperature from 1000° F. to 1400° F., preferably from 1200° F. to 1300° F., into the retort to mix, heat, and retort the raw oil shale in the retort. The retorting temperature of the retort is from 850° F. to 1000° F., preferably from 850° F. to 960° F., from about atmospheric pressure to about 50 psig. Air and molecular oxygen are prevented from entering the retort in order to prevent combustion of oil shale, shale oil and liberated gases in the retort.

In a fluid (fluidized) bed retort, inert fluidizing lift gas, such as light hydrocarbon gases, are injected into the bottom of the retort through a gas injector to fluidize, entrain and enhance mixing of the raw oil shale and solid heat carrier material in the retort. Other types of retorts, such as a fixed bed retort, a rock pump retort, or a rotating grate retort, can be used with a gaseous heat carrier material in lieu of solid heat carrier material.

During retorting, hydrocarbons and steam are liberated from the raw oil shale as a gas, vapor, mist or liquid droplets and most likely a mixture thereof along with entrained particulates of oil shale (dust) ranging in size from less than 1 micron to 1000 microns. The effluent product stream of hydrocarbon and steam liberated during retorting is withdrawn from the upper portion of the retort through an overhead product line 16.

In order to effectively stabilize the shale oil produced during retorting, the product stream in line 16 is rapidly injected with a normally liquid, hydrogen donor chemical quench and a hydrogen transfer catalyst through hydrogen donor quench line 18 and fresh makeup catalyst line 20, respectively, immediately after exiting the retort. It is preferred to inject the hydrogen donor quench and hydrogen transfer catalyst into the product stream after exiting the retort rather than inside the retort because hydrogen donor quenches have a tendency to undergo thermal decomposition, transformation and/or conversion under retorting residence times, temperatures, pressures, and retort operating conditions which render the hydrogen donor quench substantially less effective. The hydrogen donor quench and catalyst can be fed separately into the product line 16, if desired, or simultaneously together into the product line through a single common feed line 22. For most effective results, the feed ratio of the hydrogen donor quench to product stream in pounds of hydrogen donor quench per pound of shale oil should be: 0.1:1 to 100:1, most preferably 0.5:1 to 10:1, and the pressure and temperature of the hydrogen donor quench should be sufficient to avoid condensing the product stream. Preferably, the temperature and pressure of the hydrogen donor quench should be in the same range as the temperature and pressure at the exit of the retort, most preferably from about atmospheric pressure to about 50 psig. The hydrogen donor quench can be preheated in a furnace or heater 23, if necessary, to bring the hydrogen donor quench to the requisite temperature before injection into the product stream.

The hydrogen donor quench helps retard shale oil aging, increases agglomeration of oil shale dust, and limits polymerization and decrepitation of the shale oil. The hydrogen donor quenched product stream is also substantially less viscous (thick) than untreated product stream and is less costly to dedust, pipeline, and upgrade.

The hydrogen transfer catalyst increases the reaction rate of the hydrogen donor quench in stabilizing and retarding aging of the product stream as well as in limiting polymerization and enhancing agglomeration of shale dust in the product stream. The feed rate of the hydrogen transfer catalyst ranges from about 0.1 to about 100 pounds of catalyst per pound of hydrogen donor. The hydrogen transfer catalyst has a reaction component with one or more Group VI and/or Group VIII metals, preferably platinum, irridium, cobalt, molybdenum, nickel, chromium, and their oxides, or combinations thereof, on a suitable support, such as alumina, carbon, silica, or combinations thereof. Other hydrogen transfer catalysts which increase the reaction/stabilization rate of the hydrogen donor quench can also be used.

The hydrogen donor quenched product stream is passed through line 24 to one or more internal or external gas-solids separating devices, such as a cyclone 26 or a filter. The gas-solids separating device separates and removes the spent hydrogen transfer catalyst from the effluent product stream and simultaneously partially dedusts the effluent product stream.

The residual stream of spent catalyst and dust exists the cyclone 26 through line 28 where it is fed into a dust/catalyst solids separator 30, such as a cyclone, screen filter, or other filter where the hydrogen transfer catalysts are separated by gravity or filtration from the particulates of shale dust. The hydrogen transfer catalysts range in size from about 1/16 to about ⅛ inch and are much bigger than the particulates of shale dust. The shale dust exits the separator through dust line 32. The hydrogen transfer catalysts exit the separator through catalyst line 34 where it is removed from the system and discarded under appropriate environmental safety standards through discharge line 36. The spent hydrogen transfer catalyst can also be fed through spent catalyst line 38 to a regenerator 40 where the catalyst is combusted, regenerated, and/or treated to remove the dust and trace metals from the catalyst and/or fed into the fresh makeup catalyst line 20 for injection into the product stream in product line 16 after the product stream exits the retort.

The partially dedusted stream exits the cyclone through transport line 44 where it is transported to one or more separators 46, such as quench towers, scrubbers or fractionators, also referred to as fractionating columns or distillation columns.

Figure 2:
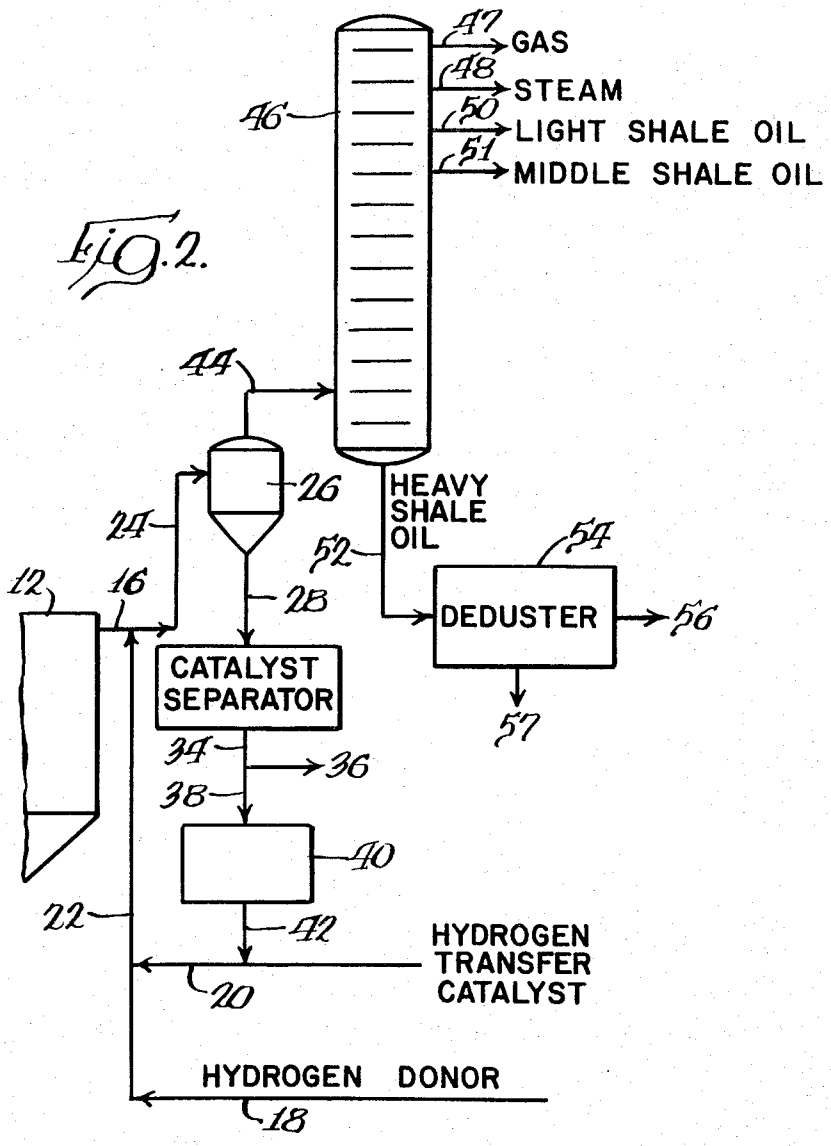
FIG. 2 is a schematic flow diagram of an alternate part of the process.

In the separator 46, the effluent product stream is separated into fractions of light hydrocarbon gases, steam, whole shale oil (FIG. 1) or light shale oil, middle shale oil, and heavy shale oil (FIG. 2). These fractions are discharged from the separator through lines 24–29, respectively. Whole shale oil comprises heavy shale oil, middle shale oil, and light shale oil. Heavy shale oil has a boiling point over 600° F. to 800° F. Middle shale oil has a boiling point over 400° F. to 500° F. and light shale oil has a boiling point over 100° F.

The solids bottom heavy shale oil fraction in the bottom separator line 52 (FIG. 2) is a slurry of dust-laden heavy shale oil that contains from 15% to 45% by weight of the effluent product stream. The dust-laden heavy oil, which is also referred to as "dusty oil," consists essentially of normally liquid heavy shale oil and from 1% to 70% by weight entrained particulates of oil shale dust, preferably at least 25% by weight oil shale dust for reasons of dedusting efficiency and economy. Whole shale oil in line 49 (FIG. 1) contains from 1% to 15%, and preferably at least 10% by weight entrained particulates of oil shale dust for more efficient dedusting. Oil shale dust is mainly minute particles of spent oil shale and lesser amounts of retorted and/or raw oil shale particulates. The temperature in the separator can be varied from 500° F. to 800° F., preferably about 600° F., at atmospheric pressure and controlled to assure that essentially all of the oil shale dust gravitates to and is entrained in the solids bottom oil fraction. Dust-laden heavy oil has an API gravity from 5° to 20° and a mean average boiling point from 600° F. to 950° F.

The hydrogen quenched, dust laden stream upon exiting the separator 46 is then dedusted in one or more dedusters (solids-liquid separation devices) 54, such as hot centrifuges, dryers, and/or desalters and otherwise processed as described in U.S. Pat. Nos. 4,404,085; 4,415,430; or 4,415,434; which are hereby expressly incorporated by reference.

In the deduster(s), the dust-laden oil is separated into a dedusted, hydrogen donor-quenched stream of shale oil, which exits the deduster through dedusted product line 56, and a residual stream of sludge laden with shale oil dust, which exits the bottom of the deduster through sludge line 57.

The dedusted, hydrogen donor-quenched stream of shale oil is fed into a first stage shale oil upgrading reactor, preferably a mild severity fixed bed hydrotreater 58. A mild severity hydrotreating catalyst is fed periodically into the hydrotreater through mild severity catalyst line 60. Hydrogen or hydrogen rich gases are injected into the hydrotreater through injection line 62. In the mild severity hydrotreater, the dedusted shale oil is contacted with the mild severity upgrading gas (hydrogen or hydrogen rich gas) in the presence of a packed (fixed) bed of mild severity hydrotreating catalysts. Typical mild severity hydrotreating operating conditions are: temperatures from about 500° F. to about 780° F., total pressure from about 300 psia to about 3000 psia, hydrogen partial pressure from about 200 psia to about 500 psia, hydrogen or hydrogen rich gas flow rate (injection rate) of about 1000 SCFB to about 5000 SCFB, and LHSV (liquid hourly space velocity) of about 0.5 to about 10 volumes of hydrocarbon per hour per volume of catalyst. The mild severity hydrotreating catalyst has a hydrogenating component, such as one or more Group VIB metals, Group VIII metals, and/or vanadium, preferably cobalt molybdenum or nickel molybdenum on a suitable support such as silica, alumina or combinations thereof. Other mild severity hydrotreating catalysts can be used, if desired.

The mild severity hydrotreated product exits the mild severity hydrotreater 58 through upgraded product line 64 where it is fed to a distillation or extraction column 66. Spent catalyst is periodically removed from the mild severity hydrotreater through spent catalyst line 68.

In the distillation or extraction column 66, the upgraded mild severity, hydrotreated product is separated at about atmospheric pressure into a normally liquid hydrogen donor fraction, a residual (intermediate) product fraction, a light oil fraction, and a hydrogen rich gaseous fraction. The hydrogen donor fraction has a boiling point ranging from about 650°0 F. to about 1000° F. and is comprised substantially of saturated mono and polycyclic aromatic rings with electro-negative heteroatoms, such as oxygen, sulfur, and nitrogen. The hydrogen donor fraction is removed from the distillation or extraction column through hydrogen donor line 18 for use as the hydrogen donor quench in line 16.

The residual (intermediate) product fraction and the light shale oil fraction are removed from the distillation or extraction column through product lines 70 and 72 and fed to a second stage, shale oil upgrading reactor, preferably a high severity fixed bed hydrotreater 74. The hydrogen rich gaseous action is withdrawn from the distillation or extraction column through overhead line 76 for use in supplying hydrogen to the mild and high severity hydrotreaters via lines 70 and 72, respectively, and/or transported elsewhere for other uses.

Hydrogen or hydrogen rich gases are injected into the high severity hydrotreater through injection line 78. High severity hydrotreating catalysts are fed to the high severity hydrotreater through high severity catalyst line 80.

In the high severity hydrotreater, the residual (intermediate) product and light shale oil are contacted with the high severity upgrading gas (hydrogen or hydrogen rich gases) in the presence of a packed (fixed) bed of high severity hydrotreating catalysts, for denitrogenation, desulfurization, and upgrading of the residual (intermediate) product and light shale oil to a blended more marketable, upgraded shale oil or syncrude. The upgraded shale oil is removed from the high severity hydrotreater through upgraded shale oil line 82. Spent catalyst is periodically removed from the high severity hydrotreater through spent catalyst line 84. Typical high severity hydrotreating operating conditions are: temperatures from about 600° F. to about 900° F., total pressure from about 500 psia to about 3000 psia, hydrogen partial pressure from about 400 psia to about 2800 psia, hydrogen or hydrogen rich gas flow rate (injection rate) of about 1000 SCFB to about 5000 SCFB, and LHSV (liquid hourly space velocity) of about 0.2 to about 5 volumes of hydrocarbon per hour per volume of catalyst.

The high severity hydrotreating catalyst can be similar to the mild severity hydrotreating catalyst, and preferably contains a phosphorous component or other compound for denitrogenation. The high severity hydrotreating catalyst most preferably comprises a chromium component, such as $Cr_2O_3$, a molybdenum component, such as $MoO_3$, a cobalt component, such as CoO, or a nickel component, such as NiO, along with a phosphorous component, such as $P_2O_5$. Other high severity hydrotreating catalysts can be used.

Retorted and spent oil shale particles from the retort 12 are discharged through the bottom of the retort and are fed by gravity flow or other conveying means through combustor feed line 84 to the bottom portion of an external dilute phase, vertical lift pipe combustor 86. The lift pipe 86 is spaced away and positioned remote from the retort. Shale dust removed by the catalyst-/dust separator 30 in line 32 can also be conveyed by gravity flow or other conveying means to the bottom portion of the combustor lift pipe. Sludge from the deduster can also be fed through sludge line 57 to the bottom of the lift pipe combustor, either directly or after being dried in a dryer, to remove any residual shale oil.

In the lift pipe combustor 86, the sludge, retorted shale, dust, and heat carrier materials are fluidized, entrained, propelled and conveyed upwardly into an overhead collection and separation bin 88 by air injected into the bottom portion of the lift pipe through air injection nozzle 90. Shale oil and any carbon residue in the sludge are substantially completely combusted in the lift pipe along with residual carbon on the retorted shale and shale dust. The combustion temperature in the lift pipe overhead vessel is from 1000° F. to 1400° F. The combusted spent sludge, combusted oil shale, and combusted spent shale dust are discharged through an outlet in the bottom of the overhead bin into heat carrier feed line 14 for use as solid heat carrier material in the retort 12. Excess spent shale and sludge are withdrawn from the overhead pin and retort system through discharge line 92.

The carbon contained in the retorted oil shale and sludge are burned off mainly as carbon dioxide during combustion in the lift pipe and overhead pin. The carbon dioxide with the air and other products of combustion form combustion off-gases or flue gases which are withdrawn from the upper portion of the overhead bin through a combustion gas line 94. The combustion gases are dedusted in an external cyclone or an electrostatic precipitator before being discharged into the atmosphere or processed further to recover steam.

While an external dilute phase lift pipe combustor is preferred for best results, in some circumstances it may be desirable to use other types of combustors, such as a horizontal combustor, a fluid bed combustor or an internal dilute phase lift pipe which extends vertically through a portion of retort. If ceramic and/or metal balls are used as the solid heat carrier material, such as for rotating pyrolysis drum retorts, the retorting system should also have a ball separator, such as a rotating trommel screen, and a ball heater in lieu or in combination with the combustor.

Residual oil and/or coke in the sludge provides auxiliary fuel for the lift pipe combustor. Light hydrocarbon gases or shale oil can also be fed to the lift pipe to augment the fuel.

While the preferred hydrogen donor is process derived in the manner described previously for process efficiency, economy, and enhanced shale oil stabilization, other hydrogen donors can also be used, if desired. Hydrogen donor compounds comprise polycyclic aromatic hydrocarbons which are partially hydrogenated, generally having one or more of the aromatic rings at least partially saturated. Hydrogen donor compounds are either added from an external source, or generated in situ from precursors contained within a suitable solvent donor vehicle. Suitable hydrogen donors include tetralin, indene, dihydronaphthalene, $C_{10}$–$C_{12}$ tetrahydronaphthalenes, hexahydrofluorene, the dihydro-, tetrahydro-, hexahydro-, and octahydrophenanthrenes, $C_{12}$–$C_{13}$ acenaphthenes, the tetrahydro-, hexahydro- and decahydropyrenes, the di-, tetra-, and octahydroanthracenes, and other derivatives of partially saturated atomatic compounds. Other suitable hydrogen donor solvents are highly aromatic, petroleum refinery resin such as fluidized catalytic cracker and catalytic reforming bottoms, which contain a substantial proportion of polycyclic aromatic hydrocarbon constituents, such as dimethylnaphthalene, anthracene, phenanthrene, fluorene, chrysene, pyrene, perylene, diphenyl, benzothiophene, naphthaline, tetralin, dihydronaphthalene, and the like. Such refractory petroleum media are resistant to conversion to lower molecular products by conventional nonhydrogenative procedures. Typically, these petroleum refinery residual and recycle fractions are hydrocarbonaceous mixtures having an average hydrogen-to-carbon ratio above about 0.7:1 and an initial boiling point above about 232° C. Further, suitable hydrogen donors are FCC main column bottoms refinery fraction obtained by the fluid catalytic cracking of gas oil in the presence of a solid porous cracking catalyst.

Among the many advantages of this process are:

1. Better dedusting and process efficiency.
2. Enhanced retorting and upgrading economy.
3. Improved shale oil stabilization.
4. Decreased oil polymerization and decrepitation.
5. Increased agglomeration of oil shale dust.
6. Better product quality.
7. Enhanced retarding of shale oil aging.
8. Viscosity control.
9. Easier shale oil pipelining.

Although embodiments of this invention have been shown and described, is is to be understood that various modifications and substitutions, as well as rearrangements of parts, components, equipment and/or process steps, can be made by those skilled in the art without departing from the novel spirit and scope of this invention.

What is claimed is:

1. A process for producing shale oil, comprising the steps of:

retorting raw oil shale in an aboveground retort by contacting said raw oil shale with heat carrier material at a retorting temperature to liberate an effluent dust-laden product stream comprising hydrocarbons and particulates of oil shale dust;

enhancing removal of said shale dust from said dust-laden product stream and stabilizing and limiting polymerization of said dust-laden product stream by contacting said dust-laden product stream comprising said hydrocarbons and said particulates of oil shale dust with a hydrogen donor quench in the presence of a hydrogen transfer catalyst at a pressure ranging from atmospheric pressure to about 50 psig;

separating a fraction of shale oil containing said hydrogen donor quench and from substantially greater than 1% to about 70% by weight oil shale dust from said hydrogen donor quenched product stream; and substantially removing said oil shale dust from said fraction.

2. A process in accordance with claim 1 wherein said retort is selected from the group consisting essentially of a screw conveyor retort, a fluid bed retort, a static mixer retort, a gravity flow retort, a rotating pyrolysis drum retort, a rock pump retort, a fixed bed retort, and a rotating grate retort.

3. A process in accordance with claim 1 including substantially removing said hydrogen transfer catalyst from said product stream by gravity separation.

4. A process in accordance with claim 1 including filtering said product stream to substantially remove said hydrogen transfer catalyst from said product stream.

5. A process in accordance with claim 1 including substantially removing said hydrogen transfer catalyst and some of said dust from said product stream in a gas-solids separator.

6. A process in accordance with claim 5 including separating said hydrogen transfer catalyst from said dust.

7. A process in accordance with claim 1 wherein said dedusted fraction is upgraded in a reactor selected from the group consisting of at least one hydrotreater, hydrocracker, and catalytic cracker, and a cut of said fraction is separated and removed from said fraction for use as said hydrogen donor quench.

8. A process in accordance with claim 1 wherein said hydrogen donor quench is petroleum resid containing a substantial portion of mono or polycyclic aromatic hydrocarbon constituents selected from the group consisting of naphthalene, dimethylnapthalene, anthracene, phenthrene, fluorene, chrysene, pyrene, perylene, diphenyl, benzothiophene, tetralin, dihydronaphthalene, and combinations thereof.

9. A process in accordance with claim 8 wherein said hydrogen donor quench is catalytic reforming bottoms.

10. A process in accordance with claim 8 wherein said hydrogen donor quench is fluid catalytic cracking bottoms.

11. A process for producing shale oil, comprising the steps of:

feeding raw oil shale into a surface retort;

feeding solid heat carrier material comprising a combusted particulate-laden residual stream and combusted retorted material into said retort;

retorting said raw oil shale by mixing said raw oil shale with said solid heat carrier material in said surface retort at a retorting pressure ranging from atmospheric pressure to about 50 psig at a sufficient retorting temperature to liberate a effluent particulate-laden product stream comprising hydrocarbons and entrained oil shale particulates;

agglomerating a substantial portion of said oil shale particulates in said particulate-laden product stream by feeding a hydrogen donor and a hydrogen transfer catalyst at about the same pressure as said retorting pressure in said surface retort into said particulate-laden product stream substantially immediately after said particulate-laden product stream exits said retort;

partially dedusting said particulate-laden product stream by removing less than about 99% by weight oil shale particulates from said particulate-laden product stream in a cyclone after said hydrogen donor and said hydrogen transfer catalyst have been added to said particulate-laden product stream;

substantially removing said hydrogen transfer catalyst from said particulate-laden product stream after a substantial portion of said oil shale particulates have been agglomerated;

separating a fraction of normally liquid shale oil containing said hydrogen donor quench and a substantial portion of said entrained oil shale particulates from said hydrogen donor quenched product stream;

separating said fraction in at least one solids-liquid separation device into a substantially dedusted stream of hydrogen donor and shale oil containing a substantially lower concentration of said oil shale particulates than said fraction and a particulate-laden residual stream laden consisting a substantially higher concentration of said oil shale particulates than said fraction;

upgrading said dedusted stream with an upgrading gas comprising hydrogen in the presence of an upgrading catalyst under upgrading conditions; and substantially combusting said particulate-laden residual stream and said retorted material for use as said solid heat carrier material in said retort.

12. A process in accordance with claim 11 wherein the feed ratio of said hydrogen donor to said product stream in pounds of said hydrogen donor to pounds of said product stream is from about 0.1:1 to about 100:1.

13. A process in accordance with claim 11 wherein said feed ratio is from about 0.5:1 to about 10:1.

14. A process in accordance with claim 11 wherein said hydrogen donor comprises partially hydrogenated mono or polycyclic aromatic hydrocarbons having at least one partially saturated aromatic ring.

15. A process in accordance with claim 14 including separating a hydrogen donor fraction from said upgraded shale oil for use as said hydrogen donor quench.

16. A process for producing shale oil, comprising the steps of:

(a) feeding raw oil shale into a surface retort selected from the group consisting essentially of a screw conveyor retort with a surge bin, a rotating pyrolysis drum with an accumulator having a rotating trommel screen, a fluid bed retort, a static mixer retort with a surge bin, and a gravity flow retort;

(b) feeding solid heat carrier material comprising combusted oil shale and shale dust at a temperature ranging from about 1000° F. to about 1400° F. into said retort;

(c) retorting said raw oil shale by contacting said raw oil shale with said solid heat carrier material in said retort at a pressure ranging from atmospheric pressure to about 50 psig and at a temperature ranging from about 850° F. to about 1000° F. to liberate an effluent dust-laden product stream comprising hydrocarbons and entrained particulates of raw, retorted and combusted oil shale dust ranging in size from less than one micron to 1000 microns;

(d) withdrawing said dust-laden product stream from said surface retort;

(e) injecting a normally liquid, hydrogen donor quench into said dust-laden product stream at a feed ratio ranging from about 0.1:1 to about 100:1 pounds of hydrogen donor quench per pound of dust-laden product stream substantially immediately after said dust-laden product stream is withdrawn from said retort to enhance removal of said oil shale dust from said dust-laden product stream and substantially stabilize and limit polymerization of said dust-laden product stream and enhance agglomeration of said shale dust while concurrently feeding a hydrogen transfer catalyst at a pressure ranging from atmospheric pressure to about 50 psig into said dust-laden product stream to substantially increase the reaction rate of said hydrogen donor quench said hydrogen transfer catalyst comprising at least one reaction component selected from the group consisting of platinum, irridium, cobalt, molybdenum, nickel, chromium, and combinations thereof on a support selected from the group consisting essentially of alumina, carbon, silica, and combinations thereof;

(f) substantially removing said hydrogen transfer catalyst from said hydrogen donor quenched stream and partially dedusting said hydrogen donor quenched product stream in at least one gas-solids separation device selected from the group consisting essentially of a cyclone and a filter;

(g) separating hydrogen transfer catalyst from said shale dust in a solids separator selected from the group consisting of a cyclone and a filter;

(h) separating a fraction of normally liquid shale oil containing said hydrogen donor quench and from about 1% to about 70% by weight of said shale dust from said partially dedusted, hydrogen donor quenched product stream in at least one separator selected from the group consisting essentially of a fractionator, scrubber, and quench tower;

(i) feeding said fraction of shale oil containing said shale dust and said hydrogen donor quench at a temperature above the pour point of said shale oil to at least one deduster selected from the group consisting essentially of a centrifuge, desalter, and dryer;

(j) separating said fraction in said deduster into a substantially dedusted product stream comprising shale oil and said hydrogen donor quench and a residual stream of sludge comprising substantially shale dust;

(k) substantially combusting said retorted shale and said separated shale dust in a combustor selected from the group consisting of a lift pipe combustor, a generally horizontal combustor and a fluid bed combustor, to form heat carrier material for use in steps (b) and (c);

(l) contacting said dedusted stream with a mild severity upgrading gas selected from the group consisting of hydrogen and hydrogen rich gas in the presence of a mild severity catalyst under mild severity upgrading conditions in a first stage upgrading reactor selected from the group consisting of a hydrotreater and a hydrocracker;

(m) separating said mild severity upgraded product stream into a hydrogen rich gaseous fraction, a light shale oil fraction, a residual product fraction, and a hydrogen donor fraction in a separator selected from the group consisting of a distillation column and an extraction column;

(n) contacting said residual product fraction with a high severity upgrading gas selected from the group consisting of hydrogen and a hydrogen rich gas in the presence of a high severity catalyst under high severity upgrading conditions in a second stage upgrading reactor selected from the group consisting of a hydrotreater, catalytic cracker, and a hydrocracker;

(o) recycling said hydrogen donor fraction for use as said hydrogen donor quench in step (e); and (p) substantially removing trace metals and shale dust from said hydrogen transfer catalyst after said hydrogen transfer catalyst has been removed from said hydrogen donor quenched product stream and then recycling said hydrogen transfer catalyst for use in step (e).

17. A process in accordance with claim 16 wherein said hydrogen donor quench substantially comprises partially saturated polycyclic aromatic rings with heteroatoms selected from the group consisting of oxygen, sulfur, nitrogen, and combinations thereof and said feed ratio ranges from about 0.5:1 to about 10:1 pounds of hydrogen donor quench per pound of particulate-laden product stream.

18. A process in accordance with claim 16 wherein said dedusted stream is contacted with said mild severity upgrading gas in the presence of said mild severity catalyst in a fixed bed hydrotreater under mild severity upgrading conditions and said residual product fraction is contacted with said high severity upgrading gas in the presence of said high severity catalyst in another fixed bed hydrotreater under high severity upgrading conditions.

19. A process in accordance with claim 16 including regenerating said hydrogen transfer catalyst.

* * * * *

UNITED STATES PATENT OFFICE
CERTIFICATE OF CORRECTION

Patent No. 4,536,277 Dated AUGUST 20, 1985

Inventor(s) Thomas M. O'Grady, David F. Tatterson, Ronald Coates

It is certified that error appears in the above-identified patent and that said Letters Patent are hereby corrected as shown below:

| Patent Column | Line | |
|---|---|---|
| 12 | 32 | reads "petroleum resid" and should read --petroleum refinery resid-- |
| 12 | 54 | reads "liberate a effluent" and should read -- liberate an effluent-- |
| 13 | 18 | reads "consisting" and should read --containing-- |
| 10 | 40 | reads "overhead pin" and should read --overhead bin-- |

Signed and Sealed this

First Day of July 1986

[SEAL]

Attest:

DONALD J. QUIGG

Attesting Officer

Commissioner of Patents and Trademarks